US007866498B2

(12) United States Patent
Cassina

(10) Patent No.: US 7,866,498 B2
(45) Date of Patent: Jan. 11, 2011

(54) CONTAINER FOR LIQUIDS

(75) Inventor: Virigino Cassina, Gorle (IT)

(73) Assignee: Daviplast-Servicos De Consultoria, Sociedade Unipessoal Lda. (PT)

( * ) Notice: Subject to any disclaimer, the term of this patent is extended or adjusted under 35 U.S.C. 154(b) by 272 days.

(21) Appl. No.: 12/127,982

(22) Filed: May 28, 2008

(65) Prior Publication Data

US 2009/0001078 A1 Jan. 1, 2009

(30) Foreign Application Priority Data

Jun. 28, 2007 (EP) ..... 07398009

(51) Int. Cl.
*B65D 6/00* (2006.01)
*B65D 8/00* (2006.01)
*H05F 3/00* (2006.01)

(52) U.S. Cl. ..... 220/4.13; 361/215

(58) Field of Classification Search ..... 220/1.6, 220/4.12, 4.13, 9.4, 88.1, 23.87, 23.91; 361/212, 361/215

See application file for complete search history.

(56) References Cited

U.S. PATENT DOCUMENTS 6,156,969 A 12/2000 Schutz
7,151,657 B2 * 12/2006 Schutz ..... 361/212
2003/0111465 A1 6/2003 Hamm
2003/0173358 A1 9/2003 Cassina

FOREIGN PATENT DOCUMENTS

DE 101 24 681 11/2002
DE 102 16 960 11/2003
EP 1 400 462 3/2004

OTHER PUBLICATIONS

Machine translation of DE 102 16 960 A1.*
European Search Report dated Oct. 17, 2008 for EP Application No. 08154667.3.

* cited by examiner

*Primary Examiner*—Harry A Grosso
(74) *Attorney, Agent, or Firm*—Jonathan D. Ball; King & Spalding LLP

(57) ABSTRACT

A liquid container (1) comprises a container body (2) with an outlet sleeve (3) having a free end (3*a*) defining an outlet opening, a drainage device (10) having a flange (11), and electrically conductive means (20) for discharging electrostatic charges from the container (1). The drainage device (10) comprises a tubular member (12) at least partly inserted into the outlet sleeve (3), and the electrically conductive means (20) comprise a first portion (21) interposed between the tubular member (12) of the drainage device (10) and the outlet sleeve (3) of the container body (2) and a second portion (22) connected to the first portion (21), disposed between the flange (11) and the free end (3*a*) of the outlet sleeve (3). The second portion (22) projects out of the drainage device (10). Particularly, the electrically conductive means are made of an electrically conductive plastic material.

10 Claims, 3 Drawing Sheets

CONTAINER FOR LIQUIDS

The present invention relates to a liquid container in accordance with the preamble of claim 1.

Liquid containers are known and used, for example, in the chemical industry for the transport and storage of chemicals. When such containers are filled or emptied, electric charges may be generated as a result of friction between the liquid and the container. The presence of electrostatic charges is very dangerous because ignition sources may come into contact with mixtures of highly explosive gases and vapors.

In order to prevent the occurrence of highly dangerous situations, it has been proposed to connect the products stored in the containers to an earth mass.

A container equipped with a system for grounding any liquids contained in the container is disclosed, for example, in U.S. Pat. No. 6,156,969 and US 2003/0111465.

U.S. Pat. No. 6,156,969 discloses a transport and storage container for liquids having a pallet-like frame of an electrically conductive material, an inner container of synthetic material with four sidewalls, a top wall and a bottom wall, an inlet opening in the top wall and an outlet opening with a drainage device in one sidewall, and an outer metal grate.

Particularly, the container comprises a grounding member of an electrically conductive material, preferably metal, arranged in the passageway of the drainage device between the outlet valve of the drainage device and the inner container to discharge the electric charges that may generate due to liquid friction during the container filling and emptying operations. For this purpose, the container is equipped with an externally-mounted electrically conductive connecting element, which comprises a grounding connection to the underframe of the container.

US 2003/111465 discloses a pallet-like container having a container wall with an outlet opening and a drainage device with a flange. The drainage device is connected to the outlet opening of the container and is fixed to the container through the flange. The container further comprises a conductive element for discharging electric charges from the container. Particularly, at least one portion of the conductive element is placed between the flange and the container wall.

While the above liquid containers fulfil electrostatic charge dissipating functions, they still have complex structures and require changes to the drainage device.

Particularly, the container of U.S. Pat. No. 6,156,969 requires a hole to be formed in the body of the drainage device for the metal grounding connection screw to be inserted from the outside.

The container disclosed in US 2003/111465 requires smaller changes but still suffers from a few drawbacks. Namely, the interposition of the conductive element between the flange and the container wall may cause liquid losses from the flange, in case of inadequate welding. Nevertheless, since the drainage device is welded to the container wall and, previously, to the flange, it is unremovable. Therefore, in case of losses caused by inadequate welding, the container is unusable and is discarded, resulting in wastage of materials, longer labor times, and higher manufacturing costs.

DE 102 16 960 discloses a liquid container wherein one sidewall is equipped with a drain connector made of a plastic material having a tightness surface. A metal hose clamp, preferably of corrosion-resistant steel, keeps such a tightness surface pressed against a corresponding surface of a plastic drain valve. An electrically conductive disc having at least one contact lever projecting inside the drain connector, is placed between the tightness surface and the drain valve and is connected toward the outside in an electrically conductive way with the hose clamp. The hose clamp is connected through an electrically conductive connection, in the example a ground lead, with a protection grid. The use of this device allows to also externally discharge an electrostatic charge generated within the container, since the inner space of the drain connector is directly connected to the inner space of the container.

Although overcoming the manufacturing problems of the containers disclosed in U.S. Pat. No. 6,156,969 and US 2003/0111465, such a container still has some drawbacks. Particularly, the use of a metal clamp having a contact lever projecting toward the inside and a clamp toward the outside, although ensuring the discharge of electrostatic charges, causes problems related to assembly, compatibility with the connectors it is connected to and tightness with respect to the plastic components upon which it is mounted.

Due to the above, there arises the need of providing a liquid container having a drainage and grounding device allowing for an efficient discharge of the electric charges that may occur as a result of the friction of the liquid in the container and which is compatible with the materials used for the container and the drainage device.

The object of the present invention is therefore to provide a liquid container that has such features as to fulfil said need, while overcoming the drawbacks of known art.

Such an object is achieved by a liquid container as defined in claim 1.

The presence of electrically conductive means made of electrically conductive plastic material results in optimal compatibility with the elements the drainage device is connected to, still maintaining high tightness.

Further features and advantages of the liquid container according to the present invention will become apparent from the following description of one preferred exemplary embodiment thereof, which is given by way of illustration and without limitation, with reference to the accompanying drawings, in which.

Figure 1:
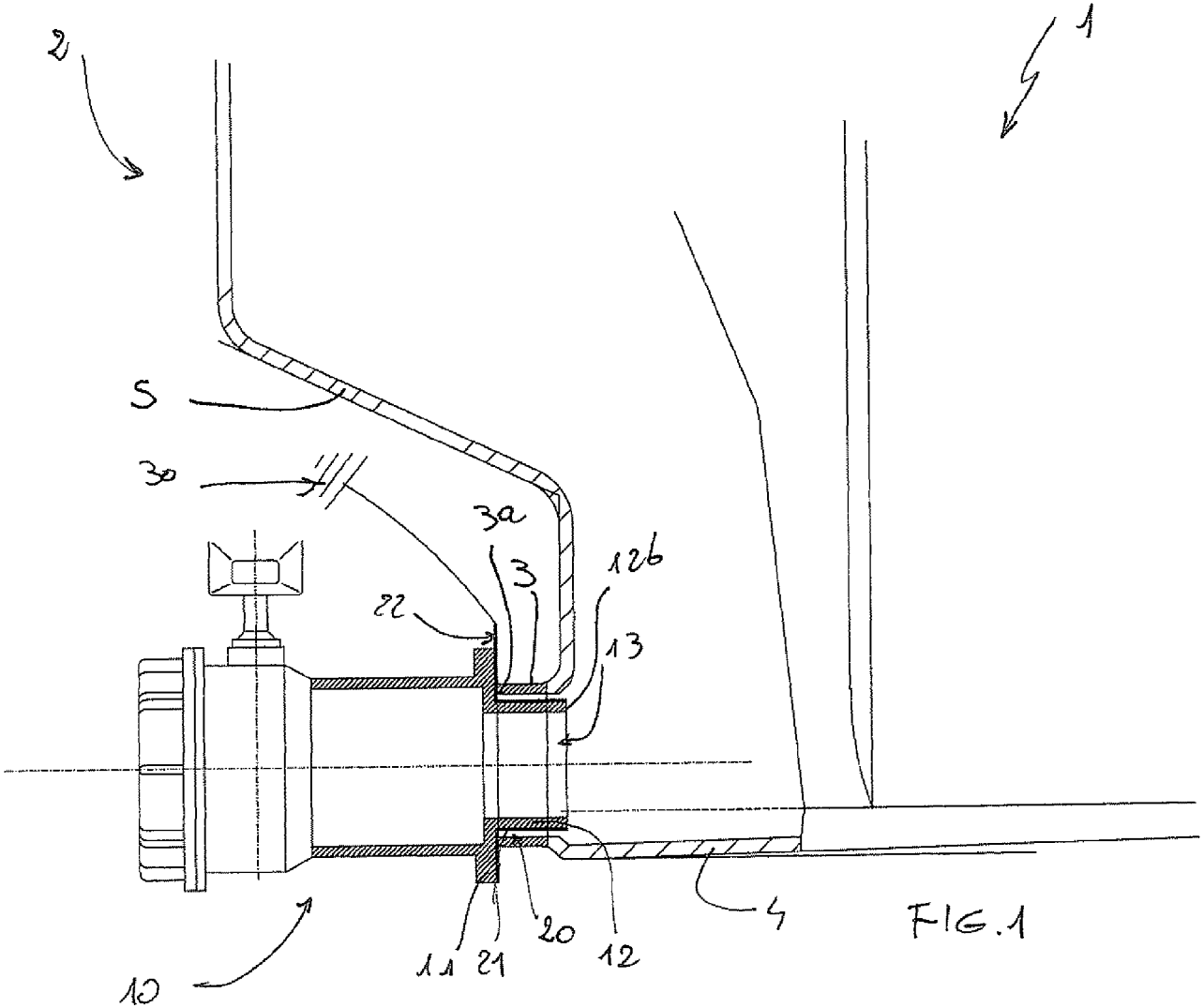
FIG. 1 shows a liquid container according to the present invention.
Figure 2:
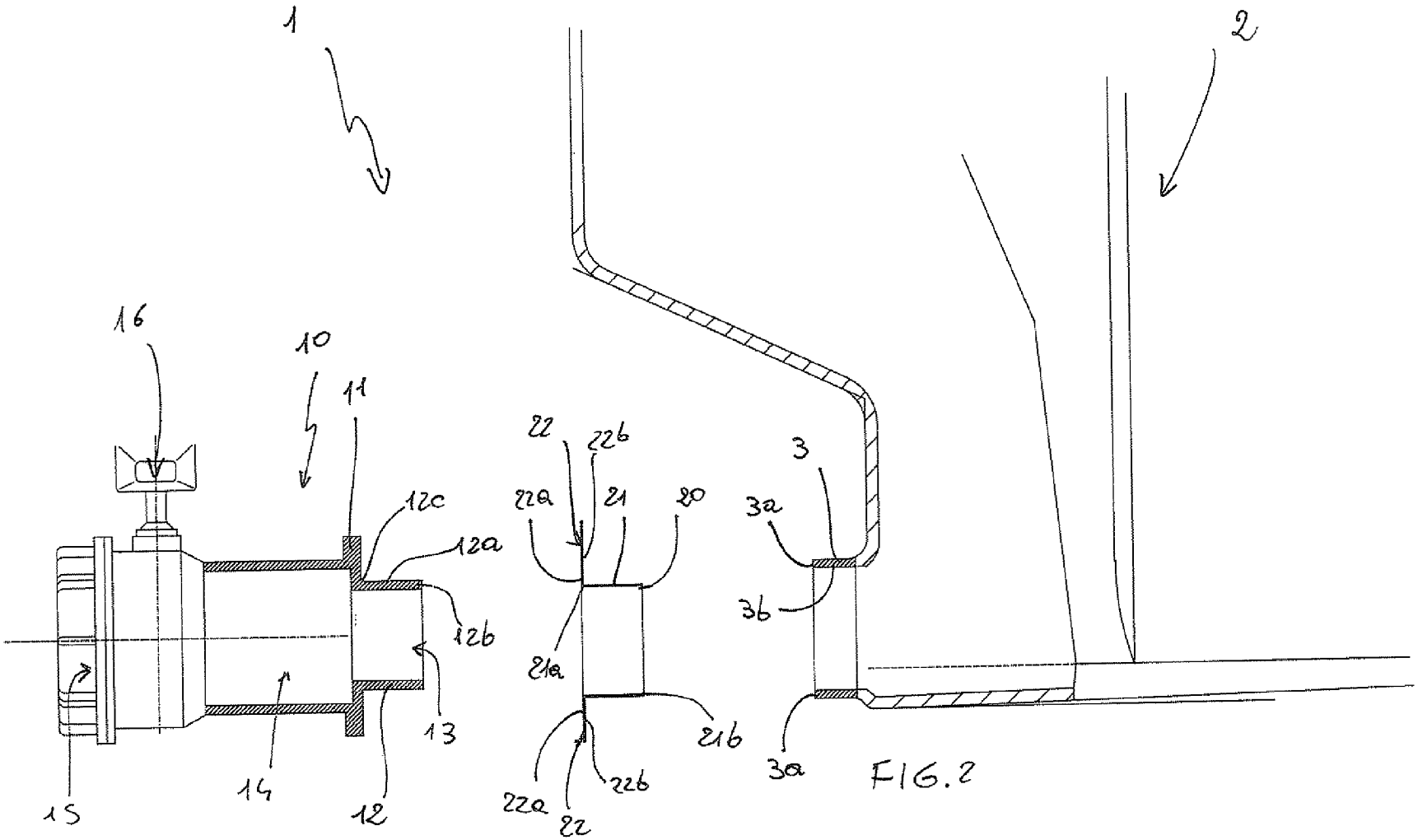
FIG. 2 is an exploded view of the container of FIG. 1.
Figure 3:
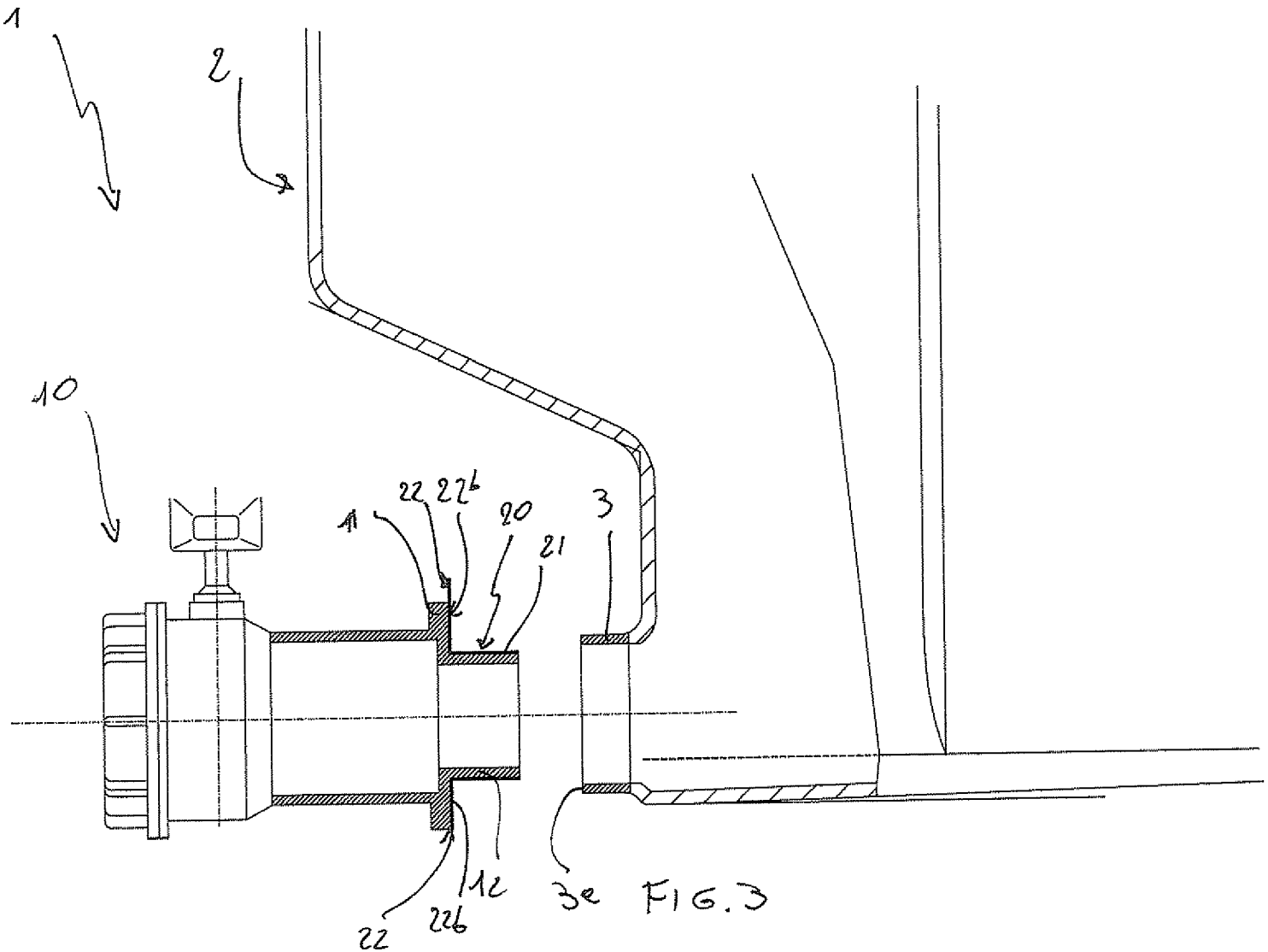
FIG. 3 is a view of the container of FIG. 1 during the assembling step of the drainage device.

Referring to the annexed figures, numeral 1 generally designates a liquid container according to the present invention.

The liquid container 1 comprises a container body 2 of plastic material with an outlet sleeve 3, a drainage device 10 of plastic material having a flange 11, and electrically conductive means, generally designated by numeral 20, for discharging electrostatic charges from the container 1.

According to a preferred embodiment, the container body 2 is formed by extrusion and blow molding from a parison of plastic material, such as polyethylene, particularly high density polyethylene, and has four sidewalls, one of which has a liquid outlet connection, a bottom wall and a top wall with a liquid inlet connection for filling the container. For simplicity, the figures only show a portion of the bottom wall 4 and a portion of a sidewall 5 of the container body 2.

The outlet sleeve 3, which defines the liquid outlet connection of the container 1, is formed at a sidewall, in the example in the lower part of sidewall 5 of the container body 2.

The drainage device 10 is made of an electrically insulating material, such as polypropylene, polyethylene, etc., eventually reinforced, e.g. with glass fibres.

The drainage device 10 further comprises a tubular member 12 which is at least partly inserted in the outlet sleeve 3 of the container body 2, from the flange 11.

Advantageously, the tubular member 12 is totally inserted in the outlet sleeve 3 up to the portion of sidewall 5 from which the outlet sleeve 3 extends. It shall be noted that the tubular member 12 may also be inserted in the outlet sleeve 3 beyond sidewall 5 to at least partly penetrate the container body 2.

The electrically conductive means 20 comprise a first portion 21 interposed between the tubular member 12 of the drainage device 10 and the outlet sleeve 3 of the container body 2 and a second portion 22, electrically connected to the first portion 21, and placed between the flange 11 of the drainage device 10 and the free end 3*a* of the outlet sleeve 3. Particularly, in order to discharge any electric charges 5 that may generate in the liquid stored in the container 1, e.g. during the filling process, the second portion 22 projects out of the drainage device 10.

Substantially, the first portion 21 is in contact with the liquid stored within the container body 2, and the second portion 22, connected to the first portion 21 and projecting out of the drainage device 10, allows for the connection with an earth mass, such as for example an earth mass 30 as shown in the figures.

According to one embodiment, the electrically conductive means are made of an electrically conductive plastic material. This increases compatibility with the plastic materials the electrically conductive means are connected to, while maintaining a high tightness of the drainage device.

According to one embodiment, the electrically conductive plastic material is a heat-sealable polymeric material comprising carbon black, stainless steel, nickel, aluminium fibres, copper or combinations thereof. More specifically, the presence of these components within the plastic material matrix results in the heat-sealable polymeric material being conveniently and advantageously conductive. Suitable heat-sealable polymeric materials are selected from polyolefins, fluorinated polymers and mixtures thereof. Preferably, said heat-sealable polymeric material is polypropylene or high density polyethylene. More preferably, said electrically conductive plastic material is high density polyethylene (HDPE) comprising carbon black.

According to one embodiment, the first portion 21 is interposed between the outer surface 12*a* of the tubular member 12 of the drainage device 10 and the inner surface 3*b* of the outlet sleeve 3 of the container body 2.

In the example showed in the annexed figures, the electrically conductive means 20 comprise a tubular sleeve 21 extending lengthwise in a X-X direction, and at least partly fitting onto the tubular member 12 of the drainage device 10.

Advantageously, the tubular sleeve 21 is totally fitted onto the tubular member 12 up to the free end 12*b* opposite the end 12*c* from which the flange 11 extends. Again, it shall be noted that the tubular sleeve 21 may be also fitted onto the tubular member 12 and terminate before or after reaching the free end 12*b* of the tubular member 12 up to at least partly penetrate the container body 2. In other words, the lengthwise extension along the X-X direction of the tubular sleeve 21 may be smaller or greater than or equal to the lengthwise extension along X-X direction of the tubular member 12.

The electrically conductive means 20 further comprise a flange 22 which extends transversely of the lengthwise X-X direction and is connected to the tubular sleeve 21.

Advantageously, the flange 22 of the electrically conductive means 20 is disposed at the end 21*a* of the tubular sleeve 21 opposite the free end 21*b*.

According to the embodiment shown in the figures, the flange 22 of the electrically conductive means 20 abuts against the flange 11 of the drainage device 10.

The tubular sleeve 21 and the flange 22 define an electrically conductive element 20 which may advantageously be welded to the tubular member 12 of the drainage device 10. Welding occurs between the flange 11 and a surface 22*a* of the electrically conductive element 20, particularly the flange 22. Alternatively, the tubular sleeve 21 may be interference-fitted onto the tubular member 12.

The assembly composed of the drainage device 10 and the conductive element 20 is in turn connected to the outlet sleeve 3. According to the embodiment of the figures, the connection is carried out by welding the free end 3*a* of the outlet sleeve 3 with the surface 22*b* of the conductive element 20, opposite the surface 22*a*.

The drainage device 10 further comprises a liquid inlet opening 13 defined by the free end 12*b* of the tubular member of the drainage device 10.

The drainage device 10 further comprises a liquid flowing conduit 14, an outlet opening 15 and a shutting valve 16, such as a throttle valve or a ball valve, for shutting off the liquid flowing through said liquid flowing conduit 14 from the inlet opening 13 to the outlet opening.

In another aspect, the present invention further relates to a process for manufacturing a liquid container 1 as described above, comprising the steps of:

a) providing a container body 2 with an outlet sleeve 3 having an end surface 3*a* defining an outlet opening, electrically conductive means 20 and a drainage device 10 having a tubular member 12;

b) welding the drainage device 10 and the electrically conductive means 20 together;

c) welding the electrically conductive means 20 and the outlet sleeve 3 together;

wherein step c) is carried out after step b) or is carried out prior to step b).

The process as described above allows to conveniently and advantageously produce the container of the invention in a rapid and cost-effective way, since it requires only a few simple and extremely rapid steps. Furthermore, the welding allows to fix the different components in an advantageously stable and safe way.

Particularly, suitable welding techniques are hot-plate heat sealing, spin welding, ultrasonic welding or vibration welding. However, because of cost-effectiveness, process efficiency, as well as final tightness reasons, heat sealing is preferred.

According to one embodiment, in the case of heat sealing, step b) comprises both heating the surface of the flange 11 of the drainage device 10 facing the tubular member 12, and heating the surface 22*a* of the flange 22 of the electrically conductive means 20 prior to welding them together; and step c) comprises both heating the surface 22*b* of the flange 22 of the electrically conductive means 20 and heating the end surface 3*a* of the outlet sleeve 3 prior to welding them together.

Particularly, step b) can be carried out after step c). This because it is easier to weld first the electrically conductive means 20 to the outlet sleeve 3 together. Specifically, by inserting the drainage device 10 in its final location, i.e. with the tubular member 12 of the drainage device 10 interference-fitted into the tubular sleeve 21 of the electrically conductive means 20 and therefore abutting against the electrically conductive means 20, it is conveniently possible to exert a pressure on the latter, advantageously along the X-X direction, thereby promoting the welding of the former abut against the latter. This operation allows to weld the electrically conductive means 20 together with the outlet sleeve 3 of the container of the container body 2. Then, the drainage device 10 is removed from the tubular sleeve 21 which is welded together with the outlet sleeve 3 and step c) carried out by heating the specified surfaces and then reinserting the drainage device 10. Analogously, an adequate pressure promotes the welding of the drainage device 3 abut against the electrically conductive means 20.

According to a preferred embodiment, in step a) a container body (2), electrically conductive means (20) and a drainage device (10) are provided in a pre-assembled form.

Naturally, all the aspects described hereinbefore, even advantageous and preferred, related to the liquid container 1 of the invention are the same as for the process for the manufacturing thereof.

It will be appreciated from the above that the liquid container according to the present invention allows to overcome the above-mentioned drawbacks with reference to known art.

Namely, the presence of electrically conductive means made of an electrically conductive plastic material results in optimal compatibility with the elements the drainage device is connected to, while maintaining a high drainage device tightness.

Naturally, those skilled in the art, in order to meet contingent and specific needs, will be able to make many changes and alterations to the according to the invention described hereinbefore, all however falling within the protection scope as defined by the following claims.

The invention claimed is:

1. A liquid container, comprising:

a container body of plastic material, with an outlet sleeve having a free end defining an outlet opening;

a drainage device of plastic material, having a flange;

electrically conductive means for discharging electrostatic charges from the container, wherein said drainage device comprises a tubular member at least partly inserted in said outlet sleeve, said electrically conductive means comprise a first portion interposed between said tubular member of said drainage device and said outlet sleeve of said container body and a second portion electrically connected to said first portion and positioned between said flange and the free end of said outlet sleeve, said second portion projecting out of said drainage device, said electrically conductive means is made of an electrically conductive plastic material, said first portion of said electrically conductive means comprises a tubular sleeve extending along a lengthwise direction and at least partly fitting onto said tubular member of said drainage device, said second portion of said electrically conductive means comprises a flange extending transversely of said lengthwise direction and connected to said tubular sleeve of said first portion of said electrically conductive means, said tubular sleeve of said first portion and said flange of said second portion connected to said tubular sleeve define an electrically conductive element, and said electrically conductive element is attached to said tubular member of said drainage device and to said outlet sleeve of said container body.

2. The liquid container according to claim 1, wherein said electrically conductive plastic material is a heat-sealable polymeric material comprising carbon black, stainless steel, nickel, aluminium fibres, or combinations thereof.

3. The liquid container according to claim 2, wherein said heat-sealable polymeric material is one of polyolefins, fluorinated polymers, and mixtures thereof.

4. The liquid container according to claim 3, wherein said heat-sealable polymeric material is polypropylene or high density polyethylene.

5. The liquid container according to claim 1, wherein said first portion of said electrically conductive means is interposed between an outer surface of said tubular member of said drainage device and an inner surface of said outlet sleeve.

6. The liquid container according to claim 1, wherein said flange of said electrically conductive means is placed at an end of said tubular sleeve that is opposite a free end of said tubular sleeve electrically conductive means.

7. The liquid container according to claim 1, wherein said flange of said electrically conductive means abuts against said flange of said drainage device.

8. The liquid container according to claim 1, wherein said electrically conductive means is connected to grounding means.

9. The liquid container according to claim 1, wherein said electrically conductive element is welded to said tubular member of said drainage device and to said outlet sleeve of said container body.

10. The liquid container according to claim 1, wherein said electrically conductive element is interference-fit onto said tubular member of said drainage device.

* * * * *